United States Patent [19]

Hugon

[11] Patent Number: 5,051,722

[45] Date of Patent: Sep. 24, 1991

[54] CENTRAL ADDRESS AND PROGRAMMING UNIT FOR FIRE ALARM DETECTOR

[76] Inventor: Emile Hugon, 21 Ave. Montaigne, Paris 75800, France

[21] Appl. No.: 344,899

[22] Filed: Apr. 28, 1989

[30] Foreign Application Priority Data

Sep. 8, 1988 [FR] France ..... 88 11721

[51] Int. Cl.[5] ..... G08B 25/00

[52] U.S. Cl. ..... 340/524; 340/525; 340/506; 340/517

[58] Field of Search ..... 340/525, 524, 506, 508, 340/505, 517, 825.06

[56] References Cited

U.S. PATENT DOCUMENTS 4,740,787 4/1988 Kimura ..... 340/506

*Primary Examiner*—Donnie L. Crosland

*Attorney, Agent, or Firm*—Kramer, Brufsky & Cifelli

[57] ABSTRACT

A central address and programming unit designed to constitute a dialogue system with a plurality of fire alarm detectors in order to characterize an alarm, the place of the disaster, technical incidents, and defects in functioning of the fire alarm detectors which are dispersed over a site includes an electronic control unit $B_G$, a control and display panel $D_A$, an electronic programming unit $C_p$ for interfacing the control and display panel $D_A$ and unit BG to the electronic programming unit and a coupling loop $A_B$ for interfacing the control unit $B_G$ to the integrated circuit of the pickups (17) for the fire alarm detctors.

10 Claims, 13 Drawing Sheets

CENTRAL ADDRESS AND PROGRAMMING UNIT FOR FIRE ALARM DETECTOR

BACKGROUND OF THE INVENTION

Up to the present time, installations have been used which have a number of different smoke detectors dispersed over a site and these make detections by pinpointing a disaster and releasing a visual or sound alarm over the site. Certain improvements have been made and consist in linking these detectors to a central unit which records the alarm or the incident, but without being able to determine the exact place. In the latter case, it was necessary to localize the disaster by carrying out an inspection of all detectors of the installation.

SUMMARY OF THE INVENTION

The present invention permits resolving these disadvantages by connecting in parallel on the same panel the different detectors placed over the site and by processing the information issued from the integrated circuits contained in each pickup.

Thus, the address of the pickup and the nature of the information emitted by the latter is determined. The different information from different pick-ups forms a dialogue between the central unit and the pickups.

The subject of the present invention is a new address system designed to constitute a central information unit, permitting a dialogue with different smoke detectors furnished with integrated circuits. This central unit displays on a visualization panel the information relative to a disaster, defect in function, the place of the disaster or of the incident, the good functioning of the circuit, whatever the characteristics of the pickup may be.

The invention thus defined presents numerous advantages, in particular:

A centralized control of the functioning state of each detector;

A rapid localizing of the alarm;

A continuous operation of the system even in the case when one detector has become out-of-commission;

A memory for the incidents which have occurred during the detection period.

The invention called "Central address and programming unit for fire alarm detector" is characterized in that it has an electronic control unit comprising an integrated circuit of several bits associated with a control clock, a defect control device, electronic flip-flops, a zero reset, a multiplexer, a data switch, an address designation, a dialogue link; a loop module comprising an integrated circuit of several bits, external memory, transmission line analyzers, a zero reset, transistor interfaces; an electronic programming device fed by an autonomous source, a multiplexing circuit, its keyboard control, its transfer relays; a control and dialogue panel which shows dialogue, address information.

The invention will be better understood by means of the attached drawings, which are given only by way of a preferential embodiment.

DETAILED DESCRIPTION OF THE INVENTION

Figure 1:
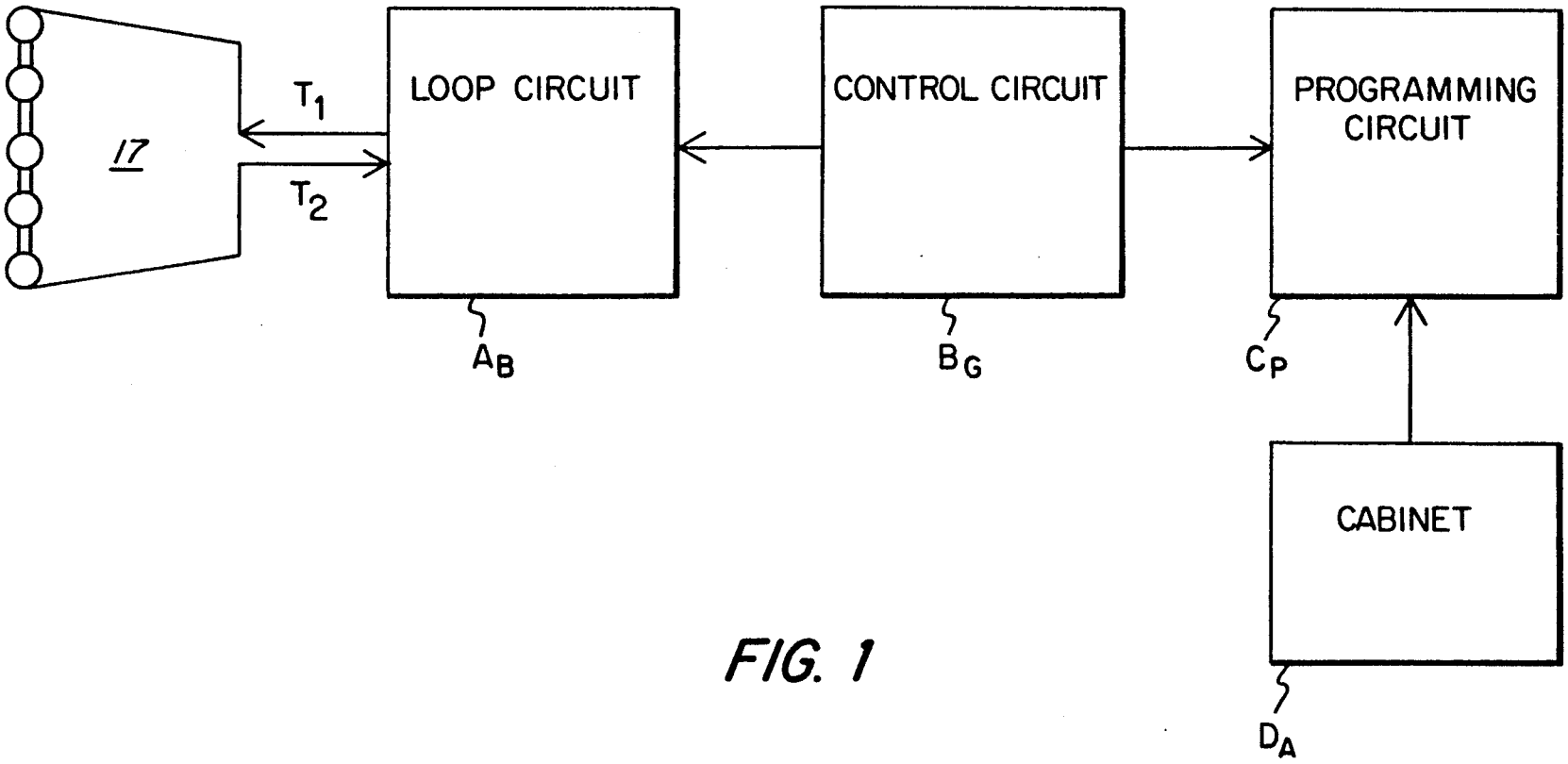
FIG. 1 is a block diagram of the, functioning of the central address and programming unit of this invention.

By referring to FIG. 1, one finds the electronic organization of the system of the central address and programming unit.

The control circuit $B_G$ is connected on one side to the loop circuit $A_B$ which plays the role of interface between the $B_G$ circuit and the integrated circuits (17) of the different pickups. The connection between the loop circuit $A_B$ and the pickups fed from transmission line $T_1$ and $T_2$.

The integrated circuits of the pickups are connected in series. Upstream from the control circuit, the programming circuit $C_P$ is shown, which constitutes an interface between the touch controls of cabinet $D_A$ manipulated by the operator and the control circuit $B_G$.

By referring to FIGS. 2, 3, 4, and 5, one finds the control circuit $B_G$. This system is comprised of an integrated circuit of 8 bits, $IC_{21}$. It is controlled by a clock $Y_1$ associated with capacitors $C_{210}$ and $C_{211}$ shown in the figure. Defects inherent in the clock are always controlled, according to FIG. 4, by an interface comprised of a transistor $Q_{25}$, resistances $R_{217}$ and $R_{218}$, and capacitors $C_{24}$ and $C_{25}$. $CR_{21}$ represents an anti-return diode.

Figure 3:
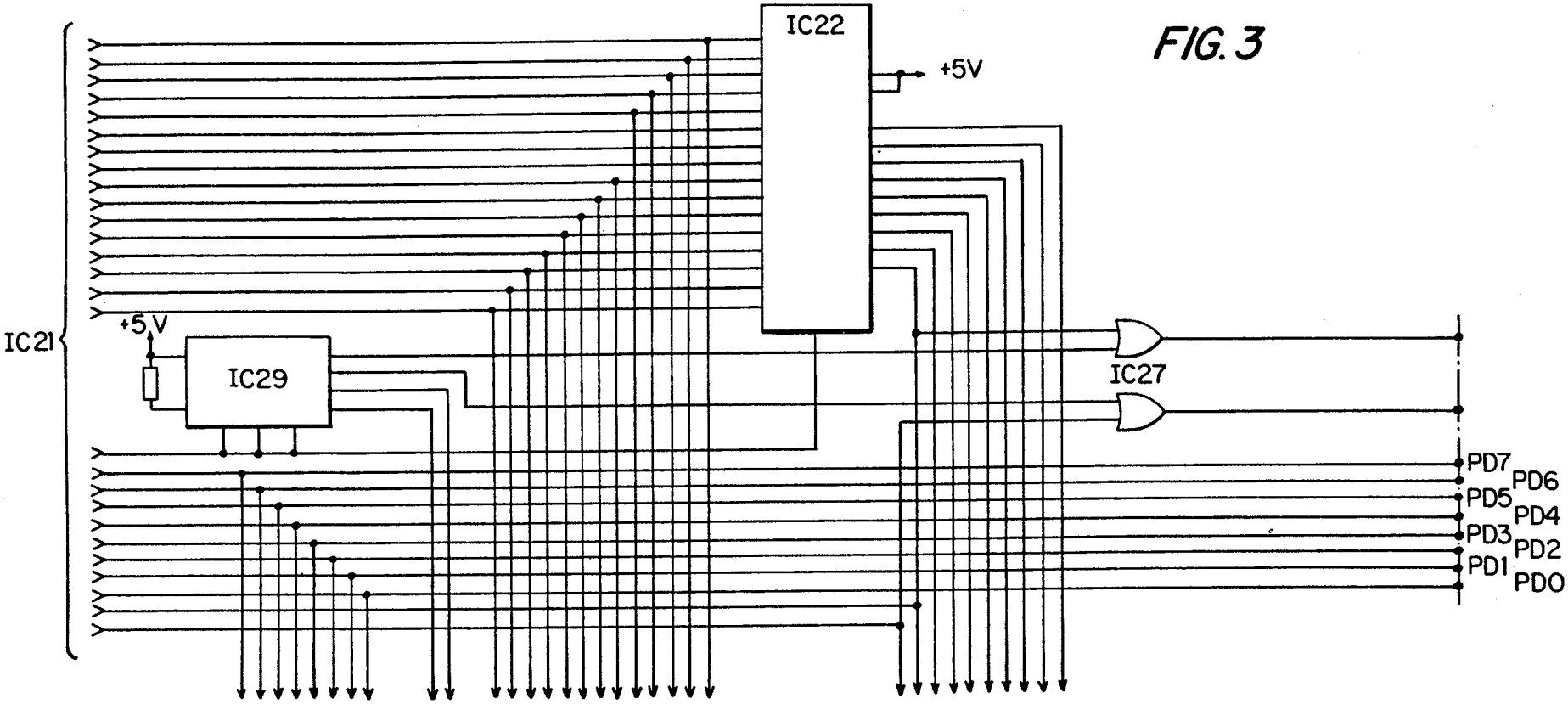

The materialization of the defect of the preceding system being appreciated at level $V_8$ of the panel of FIG. 3.

Figure 2:
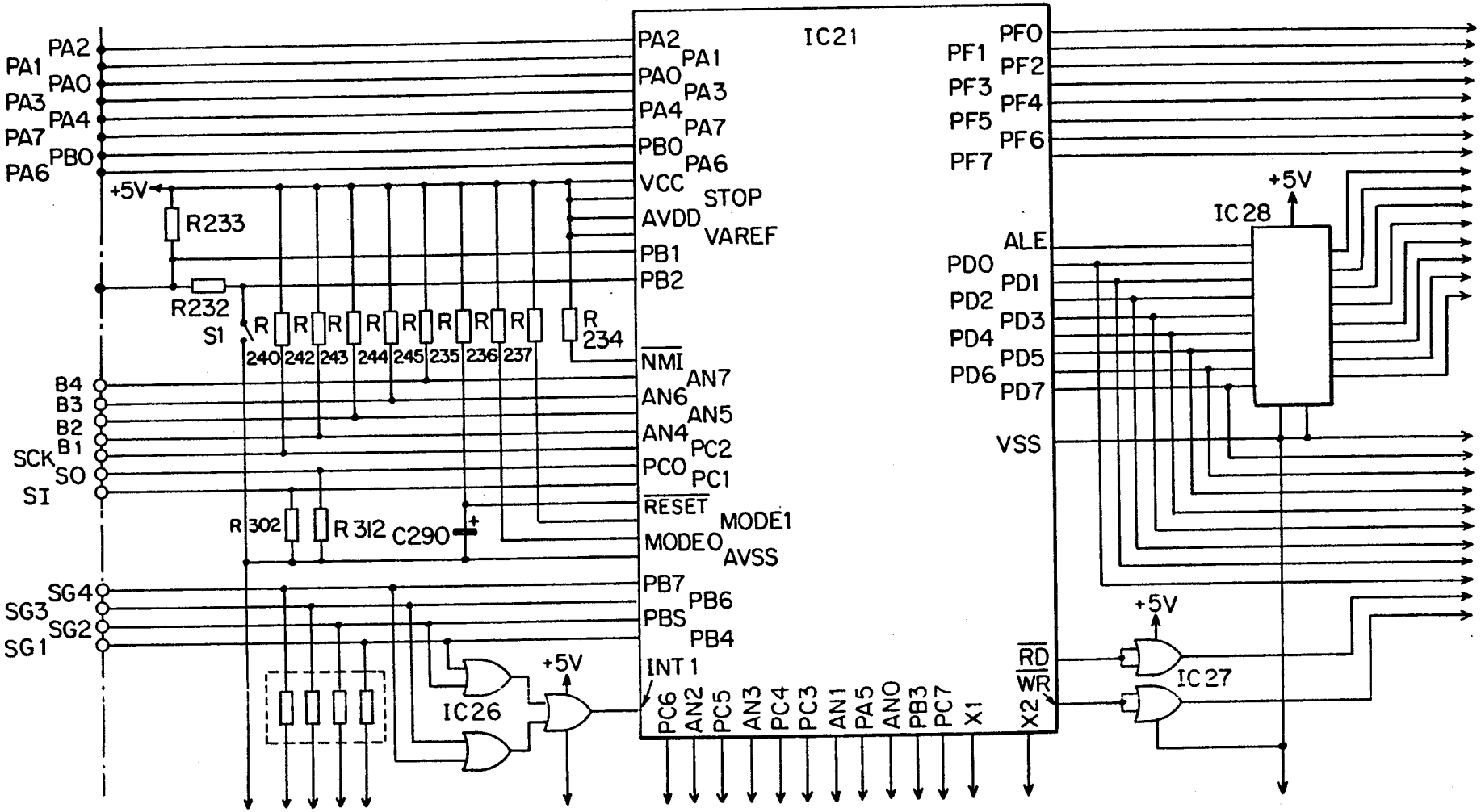
FIGS. 2, 3, 4, and 5 are schematics showing the control circuit central power of the central unit of FIG. 1.

The analysis of a fire alarm signal and its transfer, as well as the general functioning defect, are effected by $IC_{21}$ of FIG. 2 at the level of ports $AN_2$ and $AN_3$. The clock $Y_1$ periodically emits pulses of 5 V of a duration of 200 microseconds at the level of ports $PC_5$ and $PC_6$. These control pulses cross the circuit constituted by transistors $Q_{21}$ and $Q_{22}$ for positive voltage, and are analyzed by ports $AN_2$ and $AN_3$ of the integrated circuit $IC_{21}$. The negative polarity being connected by means of resistances $R_{230}$ and $R_{260}$. The integrated circuit $IC_{21}$ being connected to the loop module $A_B$ by a 3-wire $S_O$, $S_I$, $SL_K$ bus.

Figure 4:
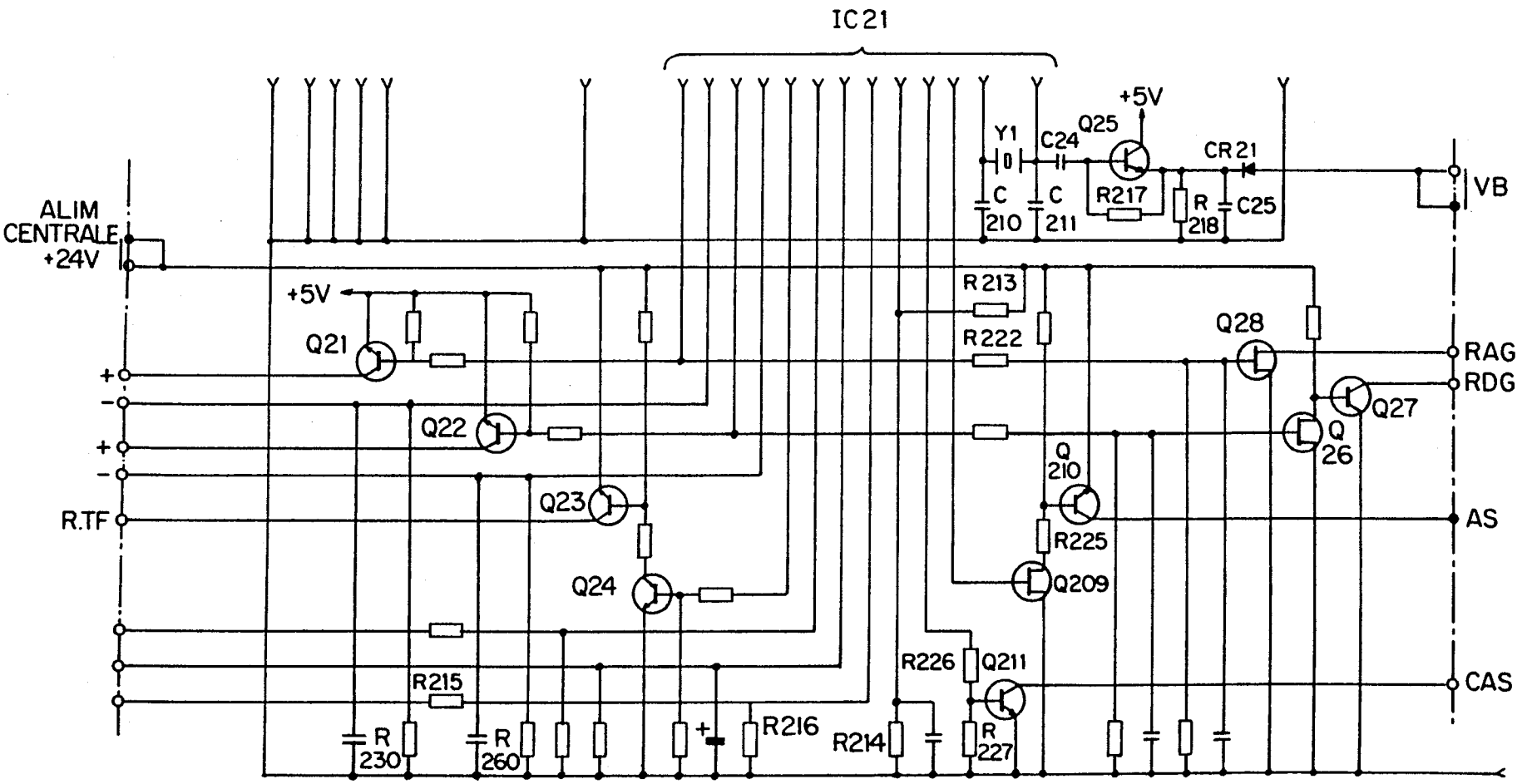

The feed control of the relay of FIG. 4 (low voltage) RTF assured by $IC_{21}$ at the level of port $PC_4$. Between port $PC_4$ and the low-voltage relay, an interface is connected, which is comprised of transistors $Q_{23}$ and $Q_{24}$ in order to isolate $IC_{21}$ from the general power supply of 24 V.

In integrated circuit $IC_{21}$, port $PC_3$ analyzes the mains voltage (24 V).

The analog port $AN_O$ of circuit $IC_{21}$ is connected to the network by means of potentiometers $R_{213}$ and $R_{214}$ in order to feed port $AN_O$ under 5 V.

Port $PB_3$, which pilots the alarm, is connected to the network by an interface which keeps the alarm under 5 V. This interface is comprised of transistor $Q_{211}$ which, associated with resistances $R_{226}$ and $R_{227}$, controls the sound alarm relay. Port $PC_7$, which controls the sound alarm of the central unit, is isolated from the 24-V network and is fed under 5 V by the interface comprised of transistors $Q_{210}$, $Q_{209}$ and resistance $R_{225}$.

When the general alarm is sounded, its transfer is controlled by port $PC_6$ of $IC_{21}$, which is isolated from the 24 V network by the interface comprised of transistor $Q_{28}$, resistance $R_{222}$. This interface connects port $P_6$ to the RAG relay control.

The control which informs a general fault is assured by port $PC_5$ associated with transistors $Q_{27}$, $Q_{26}$ which play the role of interface with the RDG control relay.

In order to assure dialogue with the "loop" module AB connected to the pickups, the $IC_{26}$ flip-flop fed under 5 V is used. In this circuit constituting the dialogue, resistances $R_{242}$, $R_{243}$, $R_{244}$, $R_{245}$, fed under 5 V, constitute circuits for a remote resetting of the relays.

The reset to zero is assured by the circuit $R_{235}$ associated with capacitor $C_{290}$.

The resistance $R_{240}$, which connects the positive polarity of the 5-V circuit, constitutes, with resistances $R_{302}$ and $R_{312}$, push-pull resistances.

Resistances $R_{236}$, $R_{237}$, and $R_{234}$ are push-pull impedances which short circuit the integrated circuit $IC_{21}$.

The resistances $R_{233}$ and $R_{232}$ constitute isolation impedances.

The integrated circuit $IC_{28}$ connects $IC_{21}$ to the data bus $IC_{29}$ of FIG. 3 and is an integrated circuit multiplexer which controls the cabinet keyboard coding.

$IC_{22}$ is an integrated circuit which constitutes the logic of the central unit and controls the relays of the Loop module.

Figure 5:
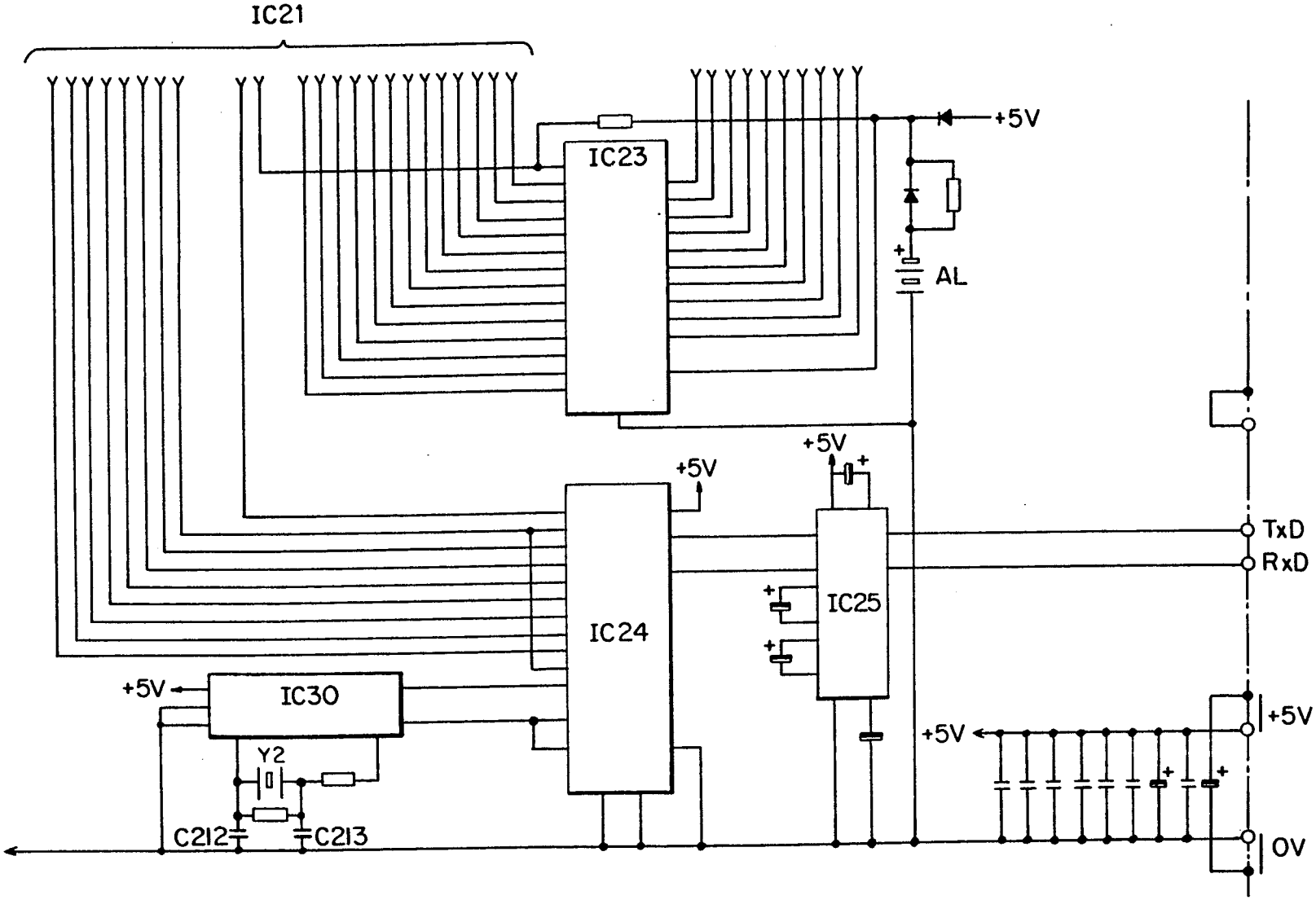

$IC_{23}$ is an integrated circuit which functions and completes or substitutes for $IC_{22}$. It may be charged by 3 6-V storage batteries (AL) in case of a defect in the power supply. $IC_{24}$ in FIG. 5 is an integrated circuit connected in series with $IC_{21}$ and which has dialogue with this latter in order to pass information to it. $IC_{25}$ is an integrated circuit which completes circuit $IC_{24}$ in order to assure a permanent dialogue with an external computer. The integrated circuit $IC_{30}$ assures the control of clock $Y_2$ which controls $IC_{24}$. This clock is associated with capacities $C_{212}$, $C_{213}$ according to the diagram known to the expert.

The assembly of other non-indexed resistances and capacities comprising equilibrating or filtering impedances.

Figure 6:
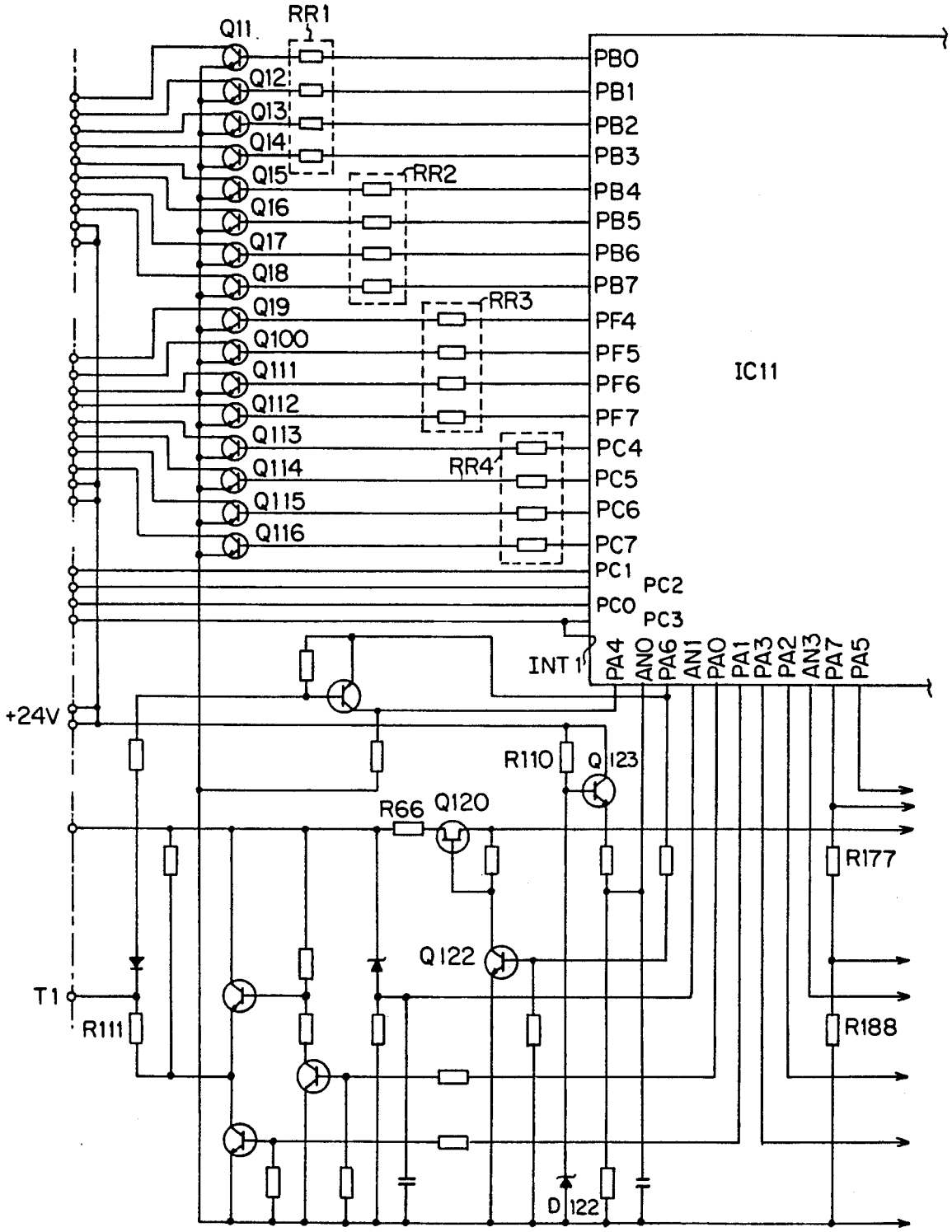
FIGS. 6 and 7 are schematics representing the "loop" circuit connected between the control circuit and the different smoke detector pickups.
Figure 7:
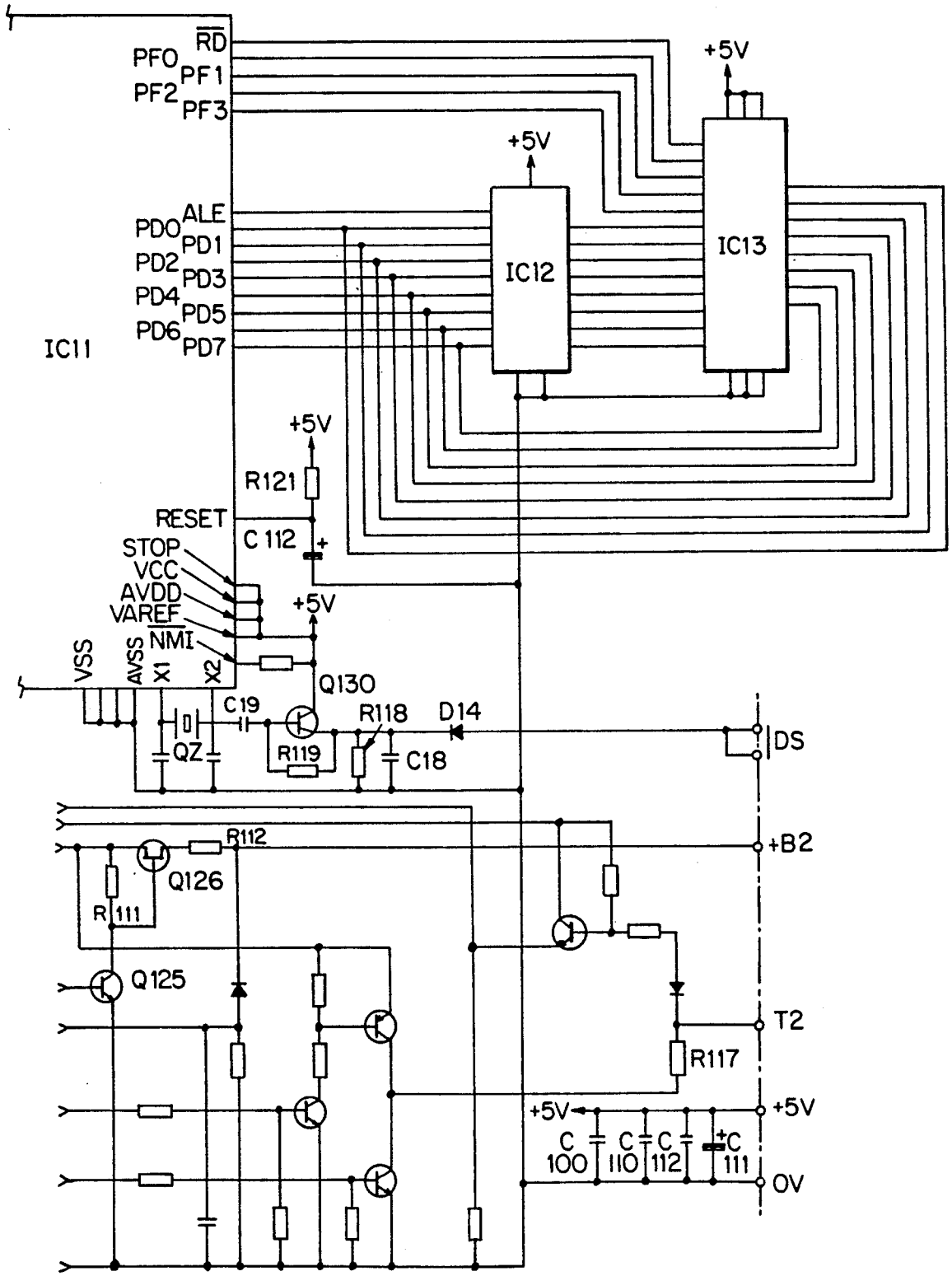

By referring to FIGS. 6, and 7 and according to one important characteristic of the invention, one finds the electronics of loop AB connecting the logic unit (17) of the fire detectors connected in parallel by a transmission line $T_1$, $T_2$.

The loop module is comprised of an integrated circuit $IC_{11}$ *with* 8 bits in FIG. 6, disposing of external memories $IC_{12}$ and $IC_{13}$ of FIG. 7.

The integrated circuit $IC_{11}$ is run by clock $Q_z$ controlled by the circuit comprising a transistor $Q_{130}$, capacities $C_{19}$ and $C_{18}$, diode $D_{14}$, and resistances $R_{119}$ and $R_{118}$. All the integrated circuits $IC_{11}$, $IC_{12}$, $IC_{13}$ are uncoupled by capacitors $C_{111}$, $C_{112}$, $C_{100}$ and each is fed by a 5-V voltage.

The integrated circuit $IC_{11}$ has its zero reset assured by the circuit comprising resistance $R_{121}$ and capacitor $C_{112}$.

On this electronic unit, short-circuit analysis is made by the circuit comprising resistance $R_{66}$ and transistors $Q_{120}$ and $Q_{122}$ of FIG. 6.

Above 350 mA between $B_1$, $B_2$ and ground, the integrated circuit $IC_{11}$ controls the opening of transistors $Q_{120}$, then $Q_{122}$. The transistor $Q_{122}$ constituting an interface. Likewise, when there is a short circuit between transmission lines $T_1$, $T_2$ and ground, resistances $R_{111}$ and $R_{117}$ serve for isolation impedances. Transistors $Q_{125}$ and $Q_{126}$ of FIG. 7 constitute the interfaces of integrated circuit $IC_{11}$ which analyzes at the level of its port $AN_3$ and controls the voltage fed to $B_1$ by its port $PA_7$ (level of 350 mA).

The power supply for the entire circuit is assured by a voltage of 21.5 V, regulated by transistor $Q_{123}$ associated with resistance $R_{110}$, diode $D_{122}$ which delivers a voltage of 21.5 V, on loop $B_1$, $B_2$.

The transmission line circuit is analyzed by $IC_{11}$ at the level of points $PA_4$ and $PA_5$.

In order to isolate the loop module from the electromechanical relays of FIG. 6 which control the "actions", 8 interfaces constituted by transistors $Q_{11}$ to $Q_{116}$ are connected between integrated circuit $IC_{11}$ and its relays. These 8 interfaces permit assuring the operation of the electromechanical relays under 24 V without problem for integrated circuit $IC_{11}$.

For example, transistor $Q_{11}$ is controlled by port $PB_O$ of $IC_{11}$ which is run to it by any other point in the central address unit.

Circuits $RR_1$, $RR_2$, $RR_3$, $RR_4$ constituting the resistance network associated with transistors $Q_{11}$ to $Q_{116}$ playing the role of interface. The integrated circuit $IC_{11}$ has 256 lines permitting receiving 8 lines of different information or rather 7 information lines and emitting one command.

By referring to FIGS. 8, 9, 10, 11, and 12, the entire electronic programming unit CP which pilots the control circuit BG can be found, and this is driven by controls found on the cabinet panel $D_A$ where they appear in the form of contact keys. FIGS. 8, 9, 10, 11, 12 are associated with each other: lengthwise, part of FIG. 8 being joined to the left part of FIG. 9, the right part of FIG. 9 being joined to the left part of FIG. 10 and the latter being fit with FIG. 12. The programming circuit is uncoupled from the electronic control unit by means of capacitors $C_{41}$, $C_{42}$, $C_{43}$, $C_{44}$, $C_{45}$, $C_{46}$.

The impedances $R_{41}$ and $R_{42}$ are so-called push-pull resistances. Resistance $R_{43}$ associated with diode LED $D_{41}$ shows the functioning when placed under voltage.

Figure 8:
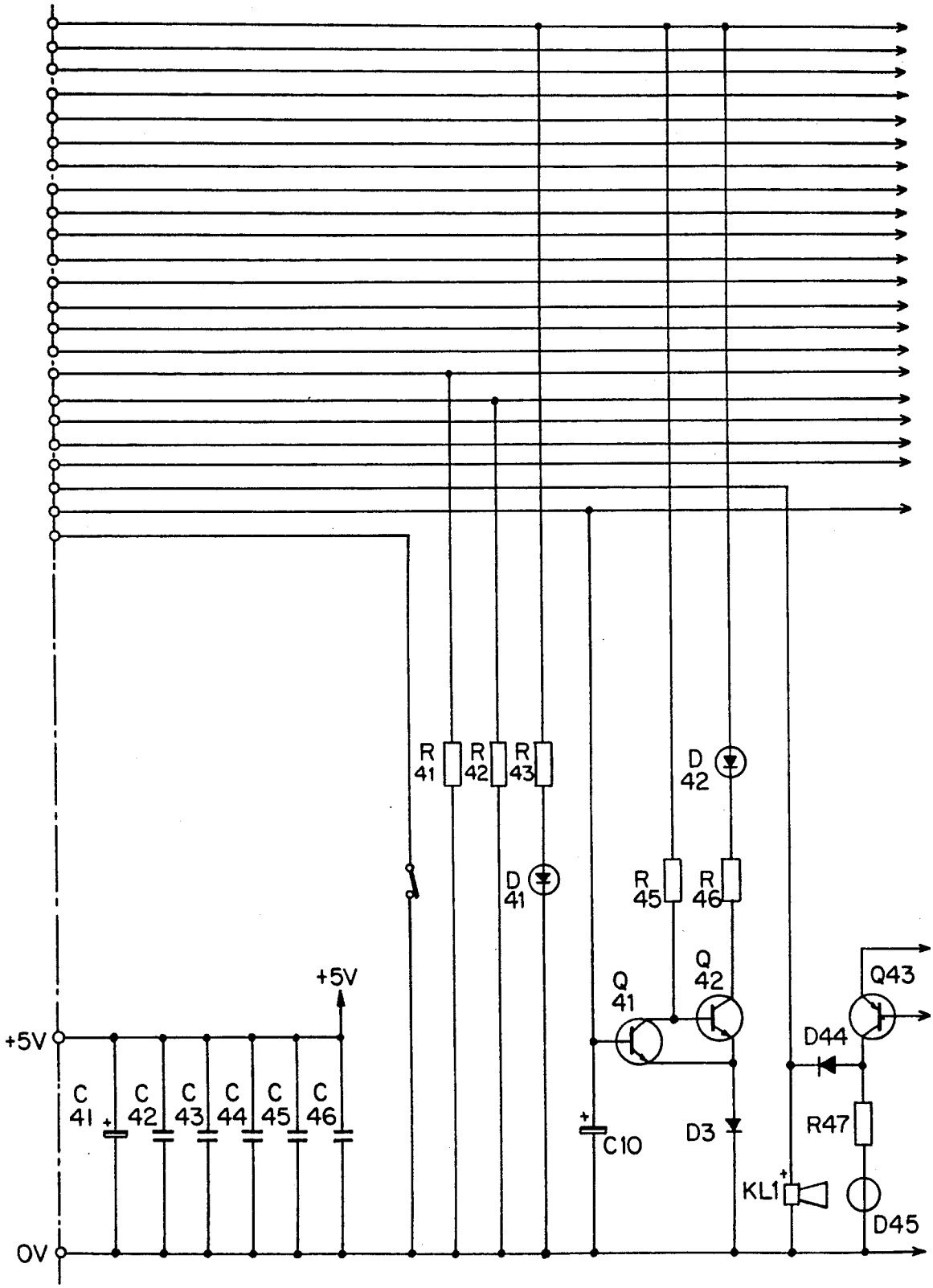
FIGS. 8, 9, 10, 11, and 12 showing the programming circuit including address circuits.

Transistors $Q_{41}$, $Q_{42}$ of FIG. 8 associated with resistances $R_{45}$, $R_{46}$ and with diode $D_{42}$ detect defects in functioning. In the latter case, diode LED $D_{42}$ is illuminated. When the circuit is operational, the battery is recharged by means of the 24-V network, whose load voltage is regulated at 3.6 V by resistance $R_{49}$ associated with transistor $Q_{44}$ and with diode $D_{47}$. In the total absence of supply current, the sound alarm $KL_1$ and diode $D_{42}$ are excited by means of transistor $Q_{43}$ and diode $D_{44}$ to indicate that the central unit is out-of-commission.

Figure 9:
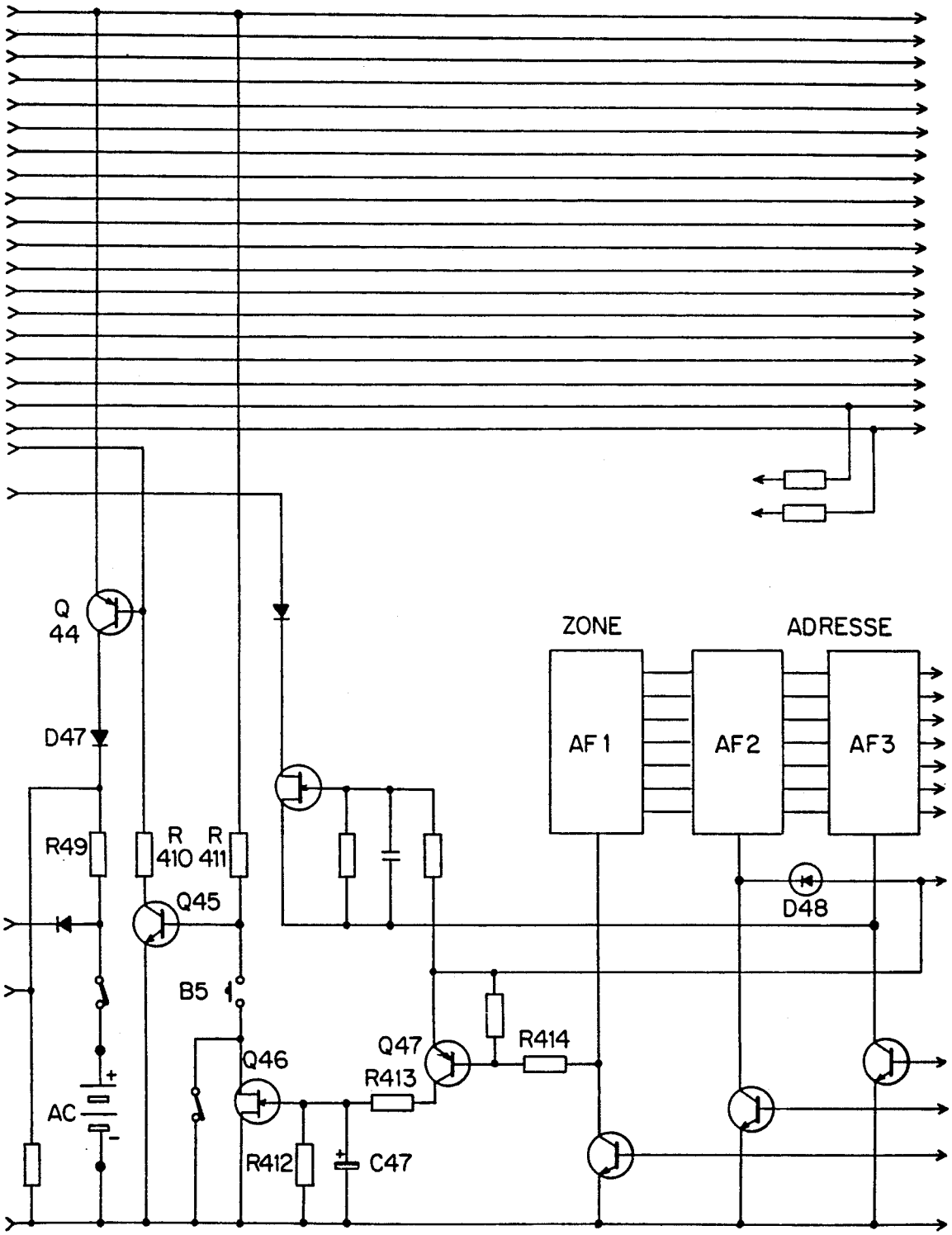

In order to check the good functioning of these alarm levels, the circuit comprised of transistors Q-hd 46, $Q_{47}$, connected to resistances R-hd 412, $R_{413}$, $R_{414}$ and to capacitor $C_{47}$ is utilized by means of the coded keyboard (FIG. 9).

Figure 10:
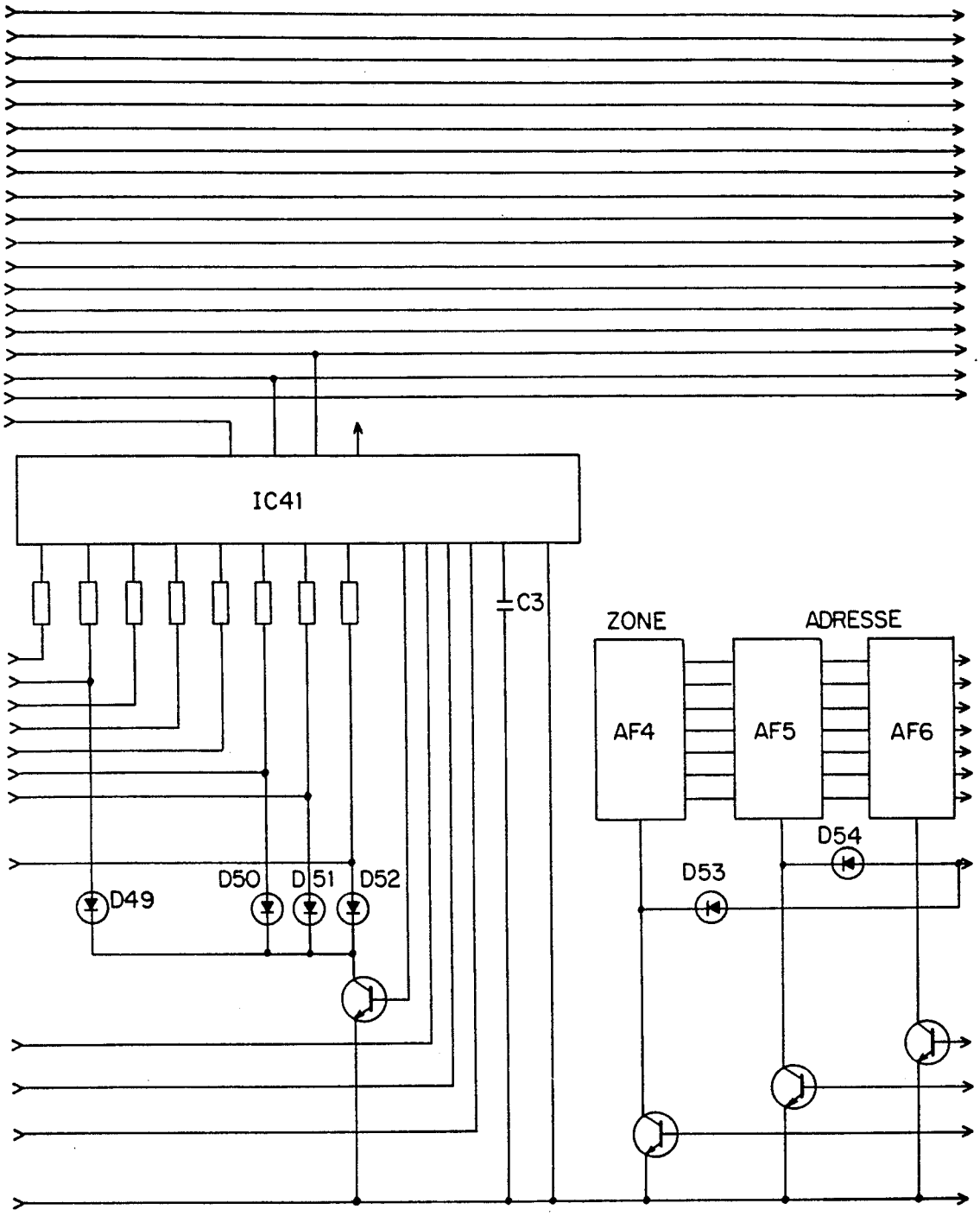
Figure 11:
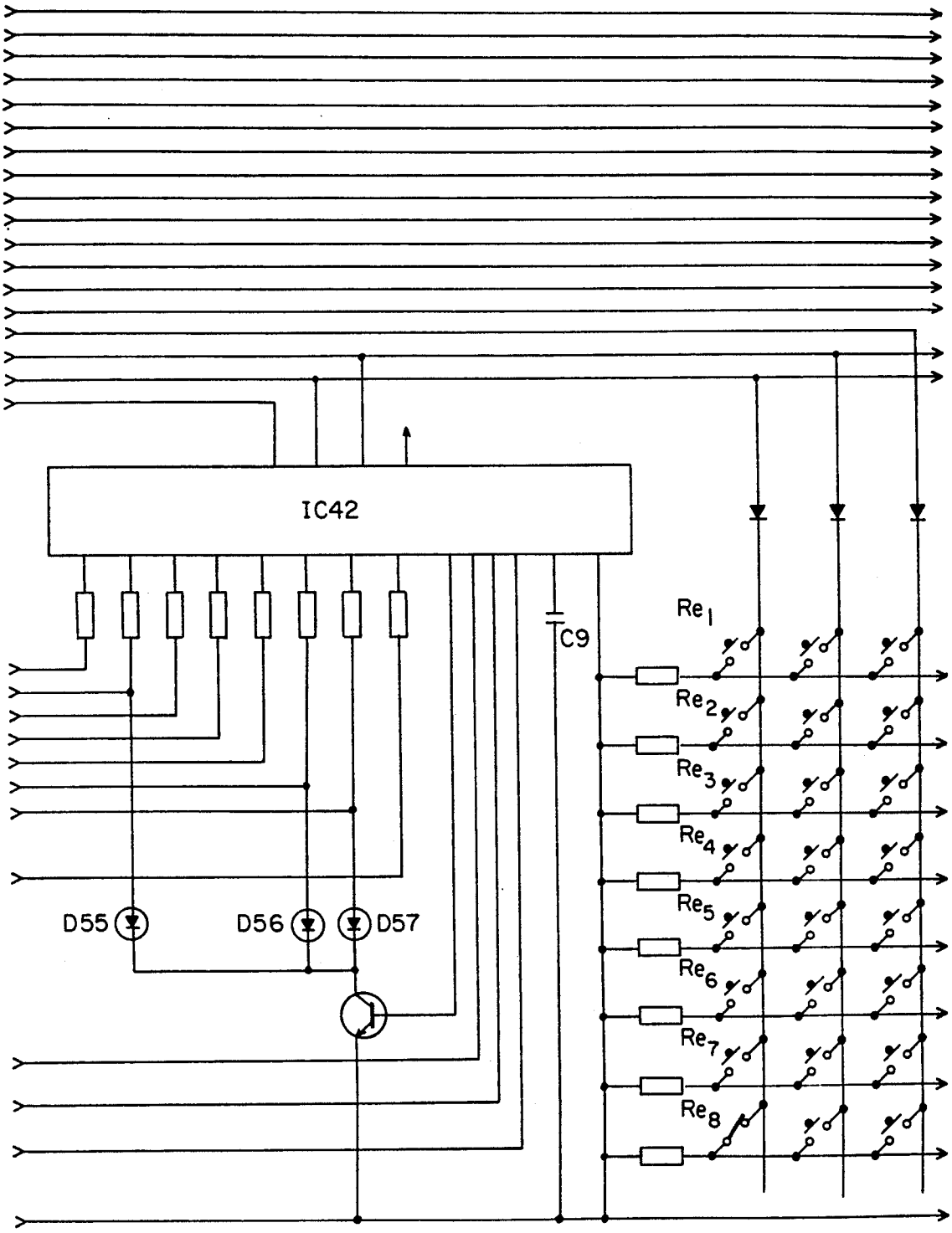
Figure 13:
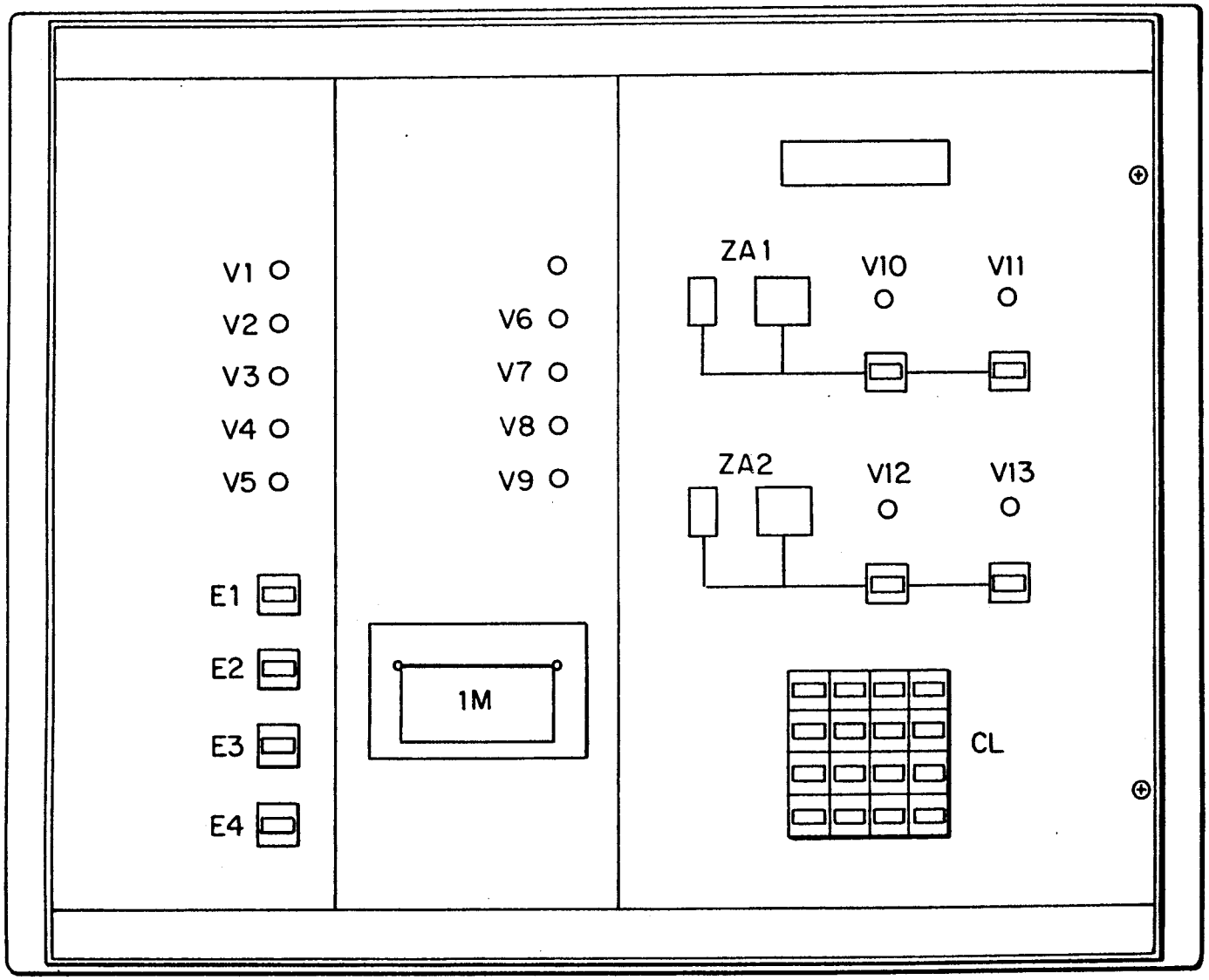
FIG. 13 is a plan view of the front surface of the cabinet of the central unit showing the dialogue between the pickups or smoke detectors and the operator.

The integrated circuit $IC_{41}$ of FIG. 10 is a multiplexer which controls the display of data placed in the external panel $AF_1$, $AF_2$, $AF_3$. These data essentially concern the address of the detector as a function of the fire alarm. Integrated circuit $IC_{42}$ of FIG. 11 is a multiplexer which runs the fault display for a detector as a function of the address of the latter. This display is indicated in FIG. 13 by $AF_4$, $AF_5$, $AF_6$.

Diodes LED $D_{48}$, $D_{49}$, $D_{50}$, $D_{51}$, $D_{52}$, $D_{53}$, $D_{54}$, $D_{55}$, $D_{56}$, $D_{57}$ constitute luminous signals which are controlled by integrated circuits $IC_{41}$ and $IC_{42}$. These diodes connected to each display panel indicate:

for $D_{48}$ a defect in the power supply
$D_{49}$ test detector
$D_{50}$ line transfer defect
$D_{51}$ fire alarm
$D_{52}$ technical alarm
$D_{53}$ general fire alarm
$D_{54}$ general fault
$D_{45}$ line defect
$D_{46}$ localized fault
$D_{47}$ out-of-commission.

These LED diodes appear on the outer panel of the cabinet.

Figure 12:
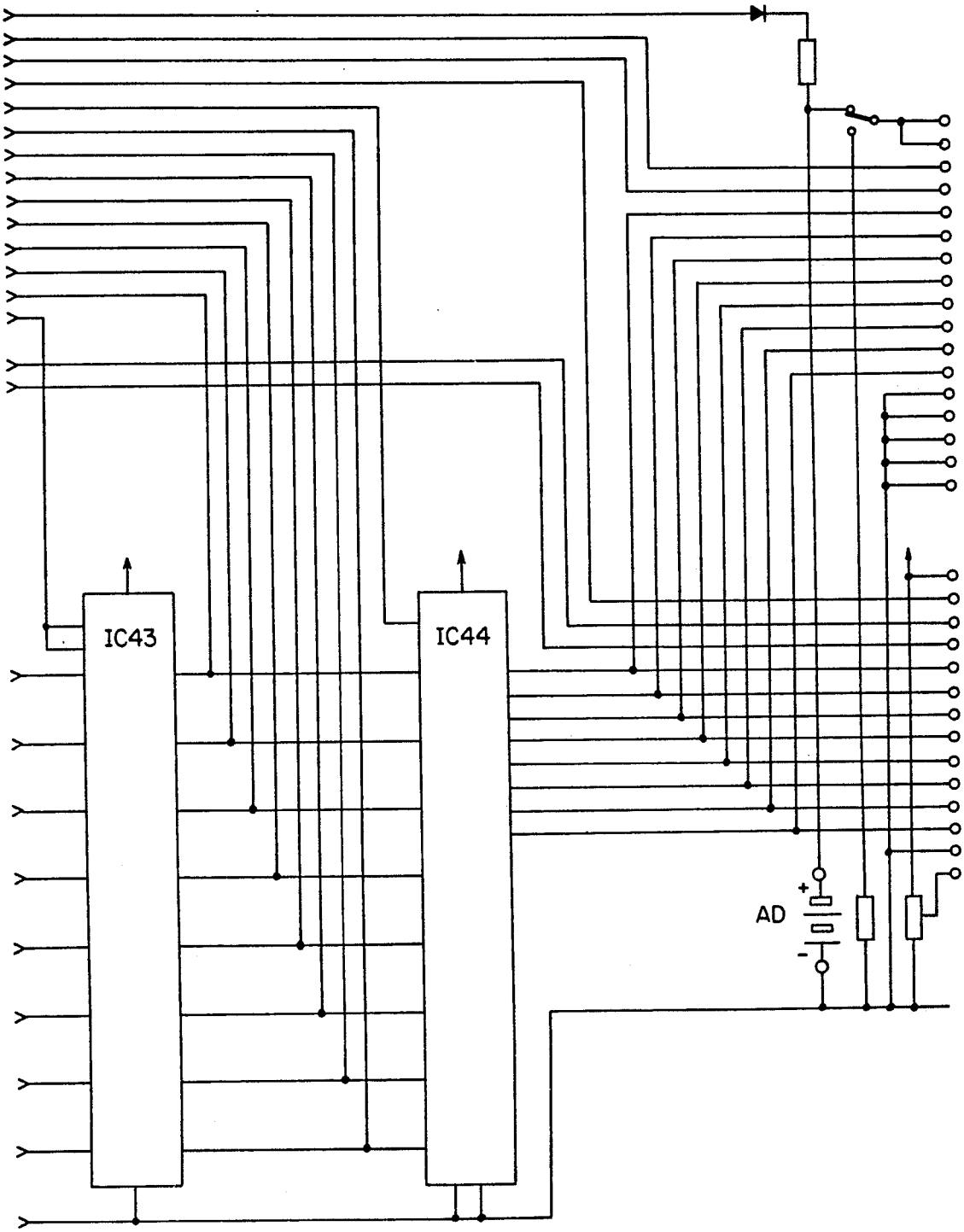

$RE_1$,$RE_2$, $RE_3$, $RE_4$, $RE_5$, $RE_6$, $RE_7$, $RE_8$ are relays that represent the control keys of the keyboard, whose electronic control is assured by integrated circuits $IC_{43}$ and $IC_{44}$ of FIG. 12. The system is supplied by a 6-volt safeguard battery AD.

FIG. 13 shows the visualization of the information system issued from the detectors and taken up by the "loop" module and the electronic control unit, as well as the controls formulated by the programming circuit.

Signal $V_1$ indicates the placing under voltage of the entire device.

Signal $V_2$ indicates a defect in power supply, while $V_3$ informs "out-of-commission."

Signal $V_4$ indicates the detector test and $V_5$ a defect in the transfer.

Each fire detector is named by a code at the level of keyboard $C_L$.

As soon as this code is recorded, signals $ZA_1$ and $ZA_2$ indicate the address and the nature of the alarm, or of the defect at the level of signal $V_6$ fire alarm, $V_7$ general fault, $V_8$ technical defect, and $V_9$, safeguard defect.

IM represents the printer.

As a function of the detector named and localized by its address at level $ZA_1$ or $ZA_2$, signal:

$V_{10}$ indicates the site of the fire alarm,
$V_{11}$ indicates the site of the technical alarm,
$V_{12}$ indicates the site of the fault,
$V_{13}$ indicates the out-of-commission alarm.

The designations $E_1$, $E_2$, $E_3$, $E_4$, indicate, respectively, the signal tests, the controls of auxiliary sources, the resetting of the system, and the stopping of the sound signals.

I claim:

1. A central address and programming unit for a plurality of fire alarm detectors connected to a logic unit, said logic unit comprising a plurality of pickups, said central address and programming unit comprising:

a. an electronic control circuit for controlling said central address and programming unit, said electronic control circuit comprising a data bus, an integrated circuit $IC_{21}$, a clock $Y_1$ for controlling integrated circuits $IC_{21}$, defect control means for controlling defects in the clock and a multiplexer for connecting integrated circuit $IC_{21}$ to the data bus;

b. a loop circuit for interfacing the electronic control circuit to the fire alarm detectors, said loop circuit comprising an integrated circuit and external memories coupled to said integrated circuit;

c. a programming circuit for pilotting the operations of said electronic control circuit, said electronic programming circuit comprising a multiplexing circuit for controlling the display of data, and for driving said programming circuit, a keyboard, said keyboard having a plurality of transfer relays that represent control keys; and d. a control and dialogue panel for operating the programming circuit and showing and printing data of address information.

2. A central address and programming unit according to claim 1, said electronic control circuit further including capacitors $C_{210}$ and $C_{211}$ connected to integrated circuit $IC_{21}$ and the defect control means comprises a transistor $Q_{25}$, resistance $R_{217}$ and $R_{218}$, and capacitors $C_{24}$, $C_{25}$, diode $CR_{21}$, said integrated circuit $IC_{21}$ being connected to the loop module by means of a 3-wire $S_0$ and $S_1$ $SL_k$ bus.

3. A central address and programming unit according to claim 1, further characterized in that integrated circuit $IC_{21}$ having a port $PC_3$ which receives a mains voltage, a port ANo which is connected to the electronic control circuit by potentiometers $P_{213}$ and $R_{214}$ and a port $PB_3$ which pilots an alarm.

4. A central address and programming unit according to claim 1 and wherein said loop circuit includes relays and said electronic control circuit further includes an integrated circuit $IC_{28}$ for interfacing integrated circuit $IC_{21}$ to the data bus, said integrated circuit $IC_{28}$ including an integrated circuit $IC_{22}$ for the control of the relays in said loop circuit.

5. A central address and programming unit according to claim 1, said control circuit including integrated circuits $IC_{23}$ for indicating the address of each fire alarm detector, each circuit $IC_{23}$ being able to substitute and complete the function of integrated circuit $IC_{22}$.

6. A central address and programming unit according to claim 1, further including integrated circuits $IC_{24}$ and $IC_{25}$ for establishing dialogue with the outside.

7. A central address and programming unit according to claim 1 and wherein said loop circuit includes an integrated circuit $IC_{11}$ for controlling the loop circuit external memories $IC_{12}$ and $IC_{13}$ for said $IC_{11}$, a clock for running $IC_{11}$, and a transistor $Q_{130}$ and associated with capacitors $C_{19}$, $C_{18}$, and diode $D_{14}$ for controlling said clock.

8. A central address and programing unit according to claim 1, and said loop circuit further including an integrated circuit $IC_{11}$ associated with resistances $R_{66}$, $R_{112}$, and transistors $Q_{120}$ and $Q_{126}$ controlled by $IC_{11}$ for analyzing short circuits.

9. A central address and programming unit according to claim 1 and further including a plurality transistors $Q_{11}$, $Q_{12}$, $Q_{13}$, $Q_{14}$, $Q_{15}$, $Q_{16}$, $Q_{17}$, $Q_{18}$, $Q_{19}$, $Q_{100}$, $Q_{110}$, $Q_{112}$, $Q_{113}$, $Q_{114}$, $Q_{115}$, $Q_{116}$ for isolating the loop circuit from the circuit.

10. A central address and programing unit according to claims 1 and further including transistors $Q_{21}$ and $Q_{22}$ for analyzing transfer and alarm malfunctions in integrated circuit $IC_{12}$.

* * * * *